US007744210B2

(12) United States Patent
Verhoest et al.

(10) Patent No.: US 7,744,210 B2
(45) Date of Patent: Jun. 29, 2010

(54) MOVING FLOOR MEDIA TRANSPORT FOR DIGITAL PRINTERS

(75) Inventors: Bart Verhoest, Niel (BE); Dirk De Ruijter, Deurne (BE); Luciaan De Coux, Heist o/d Berg (BE)

(73) Assignee: Agfa Graphics NV, Mortsel (BE)

( * ) Notice: Subject to any disclaimer, the term of this patent is extended or adjusted under 35 U.S.C. 154(b) by 220 days.

(21) Appl. No.: 11/919,023

(22) PCT Filed: May 5, 2006

(86) PCT No.: PCT/EP2006/062078

§ 371 (c)(1),
(2), (4) Date: Oct. 22, 2007

(87) PCT Pub. No.: WO2006/120163

PCT Pub. Date: Nov. 16, 2006

(65) Prior Publication Data

US 2009/0284575 A1 Nov. 19, 2009

Related U.S. Application Data

(60) Provisional application No. 60/701,377, filed on Jul. 21, 2005.

(30) Foreign Application Priority Data

May 9, 2005 (EP) ..... 05103836
May 24, 2005 (EP) ..... 05104410

(51) Int. Cl.
*B41J 2/01* (2006.01)

(52) U.S. Cl. ..... 347/104; 347/101

(58) Field of Classification Search ..... 347/104, 347/101, 103, 102
See application file for complete search history.

(56) References Cited

U.S. PATENT DOCUMENTS

| | | | | |
|---|---|---|---|---|
| 5,882,127 | A | 3/1999 | Amano | |
| 2004/0233265 | A1 | 11/2004 | Kojima | |
| 2009/0051715 | A1 * | 2/2009 | Verhoest et al. | 347/8 |

FOREIGN PATENT DOCUMENTS

| | | | |
|---|---|---|---|
| EP | 1721750 | A1 | 11/2006 |
| EP | 1721751 | A1 | 11/2006 |
| EP | 1721753 | A2 | 11/2006 |
| WO | WO 01/56804 | A1 | 8/2001 |
| WO | WO 2006-120164 | A1 | 11/2006 |
| WO | WO 2006/120166 | A1 | 11/2006 |
| WO | WO 2006/120167 | A2 | 11/2006 |

* cited by examiner

*Primary Examiner*—Manish S Shah
(74) *Attorney, Agent, or Firm*—Keating & Bennett, LLP

(57) ABSTRACT

A step-wise medium transport system is provided having high accuracy for transporting recording media in a digital printer, the medium is transported using accurately moving tables to which the medium is attached during printing steps the working area of the medium, on which the printing is done by the printer, is at all times fully supported by a static table avoiding disturbances.

12 Claims, 8 Drawing Sheets

MOVING FLOOR MEDIA TRANSPORT FOR DIGITAL PRINTERS

This application is a national stage filing under 35 USC §371 of PCT application no. PCT/EP2006/062078 filed May 5, 2006 which claims priority to EP application no. 05103836.2 filed May 9, 2005, EP application no. 05104410.5 filed May 24, 2005, and U.S. provisional patent application No. 60/701,377 filed Jul. 21, 2005.

FIELD OF THE INVENTION

The present invention relates to an apparatus for performing media transport in a printer.

More specifically the invention is related to step and repeat media transport system for an inkjet printer.

BACKGROUND OF THE INVENTION

Printing is one of the most popular ways of conveying information to members of the general public. Digital printing using dot matrix printers allows rapid printing of text and graphics stored on computing devices such as personal computers. These printing methods allow rapid conversion of ideas and concepts to printed product at an economic price without time consuming and specialised production of intermediate printing plates such as lithographic plates. The development of digital printing methods has made printing an economic reality for the average person even in the home environment.

Conventional methods of dot matrix printing often involve the use of a printing head, e.g. an ink jet printing head, with a plurality of marking elements, e.g. ink jet nozzles. The marking elements transfer a marking material, e.g. ink or resin, from the printing head to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme, (e.g. CMYK plus one or more additional spot or specialised colours). To print a printing medium such as paper or plastic, the marking elements are used or "fired" in a specific order while the printing medium is moved relative to the printing head. Each time a marking element is fired, marking material, e.g. ink, is transferred to the printing medium by a method depending on the printing technology used. Typically, in one form of printer, the head will be moved relative to the printing medium to produce a so-called raster line which extends in a first direction, e.g. across a page. The first direction is sometimes called the "fast scan" direction. A raster line comprises a series of dots delivered onto the printing medium by the marking elements of the printing head. The printing medium is moved, usually intermittently, in a second direction perpendicular to the first direction. The second direction is often called the slow scan direction.

The combination of printing raster lines and moving the printing medium relative to the printing head results in a series of parallel raster lines which are usually closely spaced. Seen from a distance, the human eye perceives a complete image and does not resolve the image into individual dots provided these dots are close enough together. Closely spaced dots of different colours are not distinguishable individually but give the impression of colours determined by the amount or intensity of the three colours cyan, magenta and yellow which have been applied.

In order to improve the veracity of printing, e.g. of a straight line, it is preferred if the distance between dots of the dot matrix is small, that is the printing has a high resolution. Although it cannot be said that high resolution always means good printing, it is true that a minimum resolution is necessary for high quality printing. A small dot spacing in the slow scan direction means a small distance between marker elements on the head, whereas regularly spaced dots at a small distance in the fast scan direction places constraints on the quality of the drives used to move the printing head relative to the printing medium in the fast scan direction.

Generally, there is a mechanism for positioning a marker element in a proper location over the printing medium before it is fired. Usually, such a drive mechanism is controlled by a microprocessor, a programmable digital device such as a PAL, a PLA, a FPGA or similar although the skilled person will appreciate that anything controlled by software can also be controlled by dedicated hardware and that software is only one implementation strategy.

One general problem of dot matrix printing is the formation of artefacts caused by the digital nature of the image representation and the use of equally spaced dots. Certain artefacts such as Moiré patterns may be generated due to the fact that the printing attempts to portray a continuous image by a matrix or pattern of (almost) equally spaced dots. One source of artefacts can be errors in the placing of dots caused by a variety of manufacturing defects such as the location of the marker elements in the head or systematic errors in the movement of the printing head relative to the printing medium. In particular, if one marking element is misplaced or its firing direction deviates from the intended direction, the resulting printing will show a defect which can run throughout the print. A variation in drop velocity will also cause artefacts when the printing head is moving, as time of flight of the drop will vary with variation in the velocity. Similarly, a systematic error in the drive system for moving the printing medium may result in defects that may be visible. For example, slip between the drive for the printing medium and the printing medium itself will introduce errors.

Especially in large size inkjet printers and industrial inkjet printing machines, the receiving medium transport system has to be very accurate and reliable in transport distance to avoid banding problems.

These systems usually must be capable to handle different sizes and thickness of receiving media.

Another problem is that the printing speed and transport speed is much higher than those of office or home inkjet printers.

These industrial printers often use a web-based material as printing stock. The web based material has to be fed very correctly as small deviations would lead to skew feeding of the web which could lead. to malfunctioning of the printer. Small feeding deviations in sheet-fed material do not pose such a problem as each sheet is independently taken from the paper bin, unless sheet-fed material is pre-printed and is to be accurately aligned in the printer to register the image to be printed to the already pre-printed image.

A problem also encountered is that printing on large size rigid media poses specific problems in respect to positioning and transporting of the media.

Rigid media normally have a greater weight than paper and have greater inertia than light materials which poses greater needs on the media transport system.

Due to the rigidity it is also possible that the material can not be straightened out easily and due to unevenness of the material surface the throw distance may vary and certain printing defects can occur.

Certain rigid materials exhibit a certain porosity so that they can not be easily transported by a transport system using vacuum forces to hold a medium. This problem is very apparent when one wants to print on mesh material, rigid or flexible.

Another aspect in industrial printers is that the shuttle containing the printheads is usually relatively heavy in comparison to home or office printers. Due to the higher shuttle speed, the drops follow a sloping path from the printhead to the receiver. Even the slightest deviation in throw distance between the head and the receiver will result in deviations in positioning the ink drops. The throw distance has to be kept constant over the full width of the shuttle and over the full length of the shuttle movement.

It has been shown that transport rollers do not provide a solution to the problems described. Another drawback is that when using large size receiving media rollers are needed in the middle of the receiving medium and that these rollers come into contact with the fresh printed surface.

In WO 01/56 804 a conveyance apparatus is provided for stepwise conveying of materials which can be used in an inkjet printer. The apparatus uses fixed and moving elements for holding the working portion of the material, being the portion of the conveyed material on which the tool, in this case the inkjet printhead, is working on. The apparatus of WO 01/56 804 has however certain drawbacks.

Support of the working portion of the receiving medium is always divided over several elements of which some completely static and some are movable for transporting the receiving medium. The support structure is formed by the movable and fixed elements Therefor it can not be assured that the material is supported over the whole width at the same height and with the same force.

Especially when printing thin, flexible media this would lead to problems.

As the moving elements are in contact with the receiving medium at the printing location no movement of these elements is tolerated during printing as longitudinal forces would be exerted upon the receiving medium at the printing location. This inevitably leads to a slower feeding speed.

The apparatus is riot able to transport materials having high porosity and mesh-like materials which are not laminated to a liner fabric.

the vacuum transport elements support only about 50% of the width of the material which gives possibly not enough force to move the heavier or porous materials.

It is clear that there is still a need for improvement of these transport systems.

It is the aim of the invention to provide a receiving media transport system that can handle all types and sizes of receiving media having a very exact positioning capability.

SUMMARY OF THE INVENTION

The above-mentioned advantageous effects are realised by a media transport system having the specific features described below. Specific features for preferred embodiments of the invention are also described below.

An inkjet printing system having such a media transport system is described below.

Further advantages and embodiments of the present invention will become apparent from the following description and drawings.

DETAILED DESCRIPTION OF THE INVENTION

Figure 1:
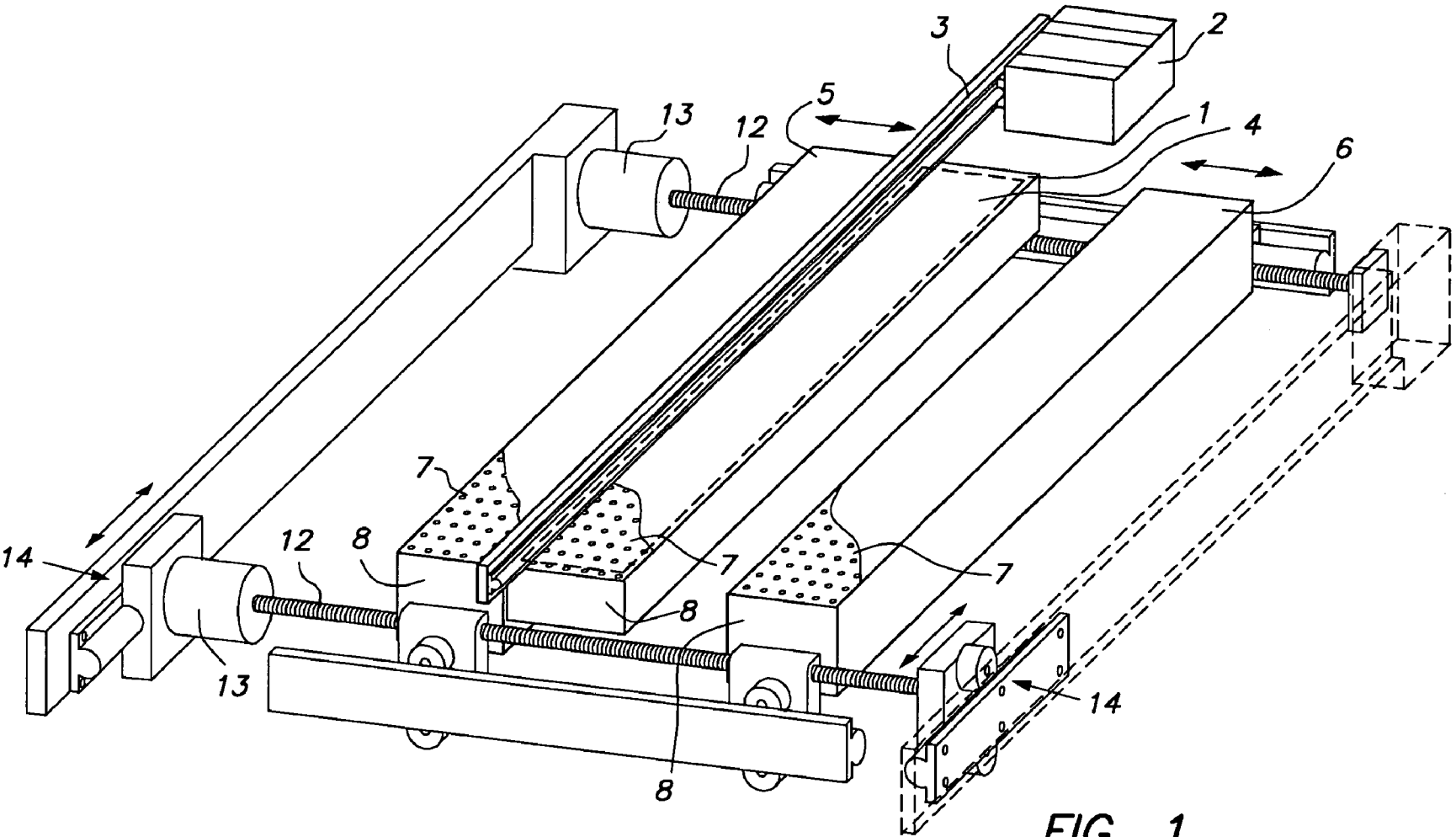
FIG. 1 gives a schematic overview of the media transport system according to the invention.

The solution to the problem is provided by a media transport system as schematically shown in FIG. 1 having at least 2 tables forming a moving floor, preferably vacuum tables, for adhering the media to them wherein during printing the working area is fully supported by a static table.

While the present invention will hereinafter be described in connection with preferred embodiments thereof, it will be understood that it is not intended to limit the invention to those embodiments.

General Description

Media transport systems as depicted in FIG. 1 normally also comprises

The printing unit with the step-wise media transport system.

A feeding roll to deliver non-printed receiving medium to the printing unit.

A take-up roll for storing the printed medium. Alternatively it is possible to deliver the material to a finishing unit to cut the material at appropriate length eventually followed by further finishing such as folding, stapling, etc . . . .

Other embodiments of the printing apparatus may comprise a sheet feeder and alignment unit in front of the printing unit having the step-wise media transport system, and a sheet lay off and stacker unit to receive the printed sheets. This embodiment may be used for flexible sheets as well as rigid materials.

These elements are however not show for clarity.

The Media Transport System.

According to the invention there is provided a static table 1 that holds the media during a printing action when the inkjet-printing head 2 performs a fast scan along a guidance 3 over the receiving media as a swath is printed. During the printing action the whole working part 4 of the receiving medium is substantially supported by the static table 1. This means that the static table 1 has at least the width and the length to support the area of the receiving material on which the recording tool will operate, in this case an inkjet printhead 2 will record a swath of the image.

As shown in the embodiment of FIG. 1 two dynamic tables 5 and 6 are present for holding and transporting the media during a transport step, but it would be possible to use only one table if the material has a certain stiffness or can be maintained in a fixed position while the one dynamic table repositions underneath the material. The transport steps are performed in between printing steps, by using a step and repeat mechanism described in more detail further on. The receiving medium is therefore always static during printing and a high accuracy in feeding the receiving medium in distance and orientation can be obtained leading to less artefacts in the printed image.

The forces for holding the receiving medium can be any sort of force but is preferable capable of being switched. The forces could be electrostatic, magnetic (certain media) or preferably vacuum.

FIG. 1 gives an overall view of the medium transport system according to the present invention using vacuum forces to hold the receiving medium.

Static Vacuum Table

According to a preferred embodiment of the invention central to the system is a static vacuum table 1 that holds the receiving medium static during the printing action.

The top surface is formed by a rigidly fixed plate having small perforations 7 of about 0.5 to 2 mm wide to enable the vacuum to attract the receiving medium lying above it during the printing action. Also small grooves (about 0.5 mm) are provided to distribute the vacuum over a larger area.

The perforations can also be replaced by small slits in the top plate.

Preferable the plate is page-wide provided at the working area 4 which is the actual area printed by the inkjet printhead 2 during a fast scan print action. The aim is to thoroughly support the receiving material over the total width of the working area 4.

Especially when using thin media this is important. No moving parts of the medium transport system are located under the working area 4. Only fixed parts are present under the working area 4.

Under the perforated plate there is provided a vacuum chamber 8 in connection with the perforations 7. Table 1 and vacuum chamber 8 form a closed box in which a vacuum can be created. Vacuum is applied and maintained by an air evacuation system, e.g. a ventilator system, drawing air out of the vacuum chamber 8 to obtain a vacuum in the chamber.

The air evacuation system has enough capacity to generate sufficient vacuum in a short time to that the receiving medium can be immobilised on the vacuum table 1 quickly.

Plural Vacuum Chambers

If the width of the receiving medium is less than the with of the plate, the problem rises that, through the perforations 7 which are not covered by the receiving sheet, air will flow into the chamber 8 and the vacuum cannot be maintained easily or is partially lost.

Figure 2:
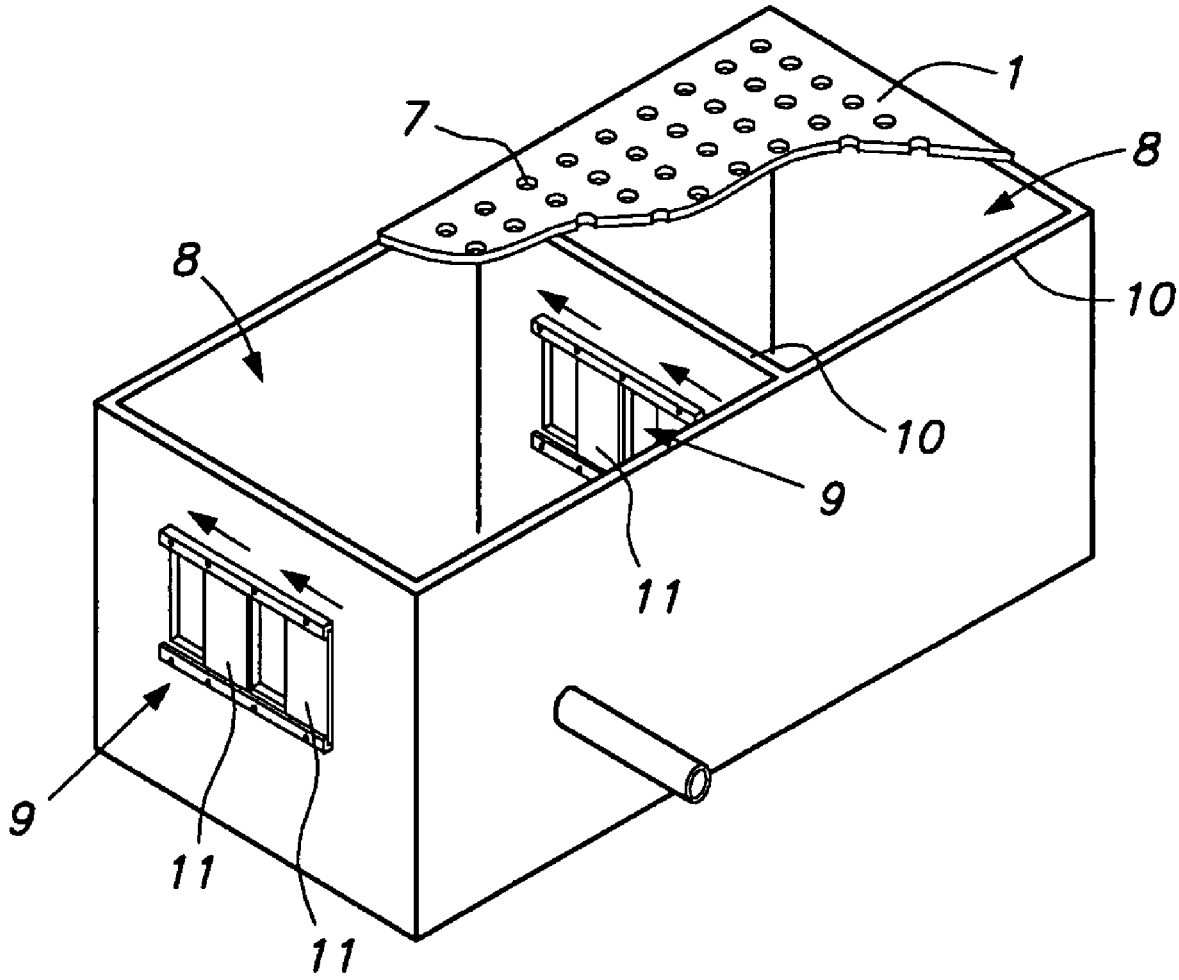
FIG. 2 depicts the principle of segmented vacuum chambers and using blind valves.

A solution to this problem, of which a possible solution is illustrated in FIG. 2 is that instead of a single vacuum chamber 8, the plate surface is divided into several fields each having their own vacuum chamber 8. Especially when the dimensions of these fields are chosen and designed in relation to common paper widths it is always possible to obtain a good vacuum to rigidly hold the receiving sheet in place. Vacuum chambers 8 outside the width of the receiving sheet may lose vacuum or may be switched of from the vacuum source, but have no influence on the holding power of those chambers 8 underneath the receiving sheet.

Vacuum Release Valve

When the receiving sheet should be released, vacuum should be discontinued in the chamber(s). This can be done by stopping the air evacuation means, but preferably a valve 9 is provided in one of the walls 10 of the vacuum chamber. The valve 9 is opened and air is let into the chamber 8 or between chambers 8. The cross-section of the valve 9 is preferably large and especially a blind 11 valve can be employed as they tend to have a large opening and they can be switched very quickly between open and closed state. Vacuum can be switched without even turning the air evacuation means off.

Dynamic Vacuum Tables

Dynamic vacuum tables 5 and 6 provide the moving part of the media transport system. These are designed to hold the receiving layer during incremental transport steps of the receiving medium and may release the receiving layer once held by the vacuum of the static table 1.

In a preferred embodiment of the invention a dynamic vacuum table 5,6 is provided at each side of the static vacuum table 1.

The top surface is formed by a plate having small perforations 7 to enable the vacuum to attract the receiving medium lying above it during the transport action. Also here slits can be provided Over at least a certain length of the receiving medium the plate is provided page-wide to keep the transport forces constant over the width of the receiving medium.

Under the perforated plate there is also a vacuum chamber 8 in connection with the perforations. Vacuum is created and maintained by an air evacuation system.

The air evacuation system has enough capacity to generate sufficient vacuum in a short time to that the receiving medium can be drawn to the dynamic vacuum table quickly.

Plural Vacuum Chambers

Likewise as in the static vacuum table 1, if the width of the receiving medium is less than the width of the plate, the problem rises that through the perforations 7 which are not covered by the receiving sheet air will flow into the chamber 8 and the vacuum cannot be maintained easily or is partially lost.

A solution to this problem given in the present invention is that instead of a single vacuum chamber 8, the plate surface is divided into several fields each having their own vacuum chamber 8.

Especially when the dimensions of these fields are chosen and designed in relation to common paper widths it is always possible to obtain a good vacuum to rigidly hold the receiving sheet in place. Vacuum chambers 8 outside the width of the receiving sheet lose vacuum or are switched of from the vacuum source, but have no influence on the holding power of the other chambers 8 underneath the receiving sheet.

As also in the static vacuum table 1, blind valves 9 form an excellent method of switching the state of the vacuum table between holding and releasing state.

As the dynamic vacuum tables 5,6 move, they preferably are of a lightweight construction that gives less inertia problems at the start and end of the transport step.

As it is the intention of the invention that both dynamic vacuum tables 5,6 move synchronously during transport of the receiving medium they are preferably relatively mounted fixed to each other. In FIG. 1 both dynamic vacuum tables 5,6 are driven by common spindles 12 so they always move at the same speed. Alternatively they can be rigidly coupled to each other to form one unit which is driven by a single spindle system 12.

At both edges of the dynamic vacuum tables a guide rail (not shown) is provided for guiding the moving tables along a correct path. Preferably the two dynamic tables have common guide rails to provide synchronous and parallel movement.

Both spindles 12 may be driven by high resolution step motors 13 to have accurate control over the length of the transport step and speed.

This can eliminate the need for encoders to determine exact position and speed of the dynamic tables 5,6.

Temperature Considerations

Due to the large width of the vacuum tables in certain industrial printing machines the thermal expansion of the tables 5,6 can not be discarded.

In an embodiment according to the invention at one side the guide rail and spindle system 12 over which the dynamic tables 5,6 move is rigidly fixed while the opposite rail can be mounted in a floating way to allow for the expansion of the tables 5,6. Using fixed rails at both sides would result in stress causing deformation of the dynamic vacuum tables 5,6 and less accurate transport of the receiving medium. A possible embodiment is given in FIG. 1 using sliding mountings 14.

Also for the static vacuum table 1 it has to be avoided that stress will occur due to thermal expansion and possibly lead to deformation of the table 1.

Method of Operation

The operation of the media transport system is a step-wise incremental transport.

During the printing action of the apparatus a web or sheet material is provided.

Figure 3A:
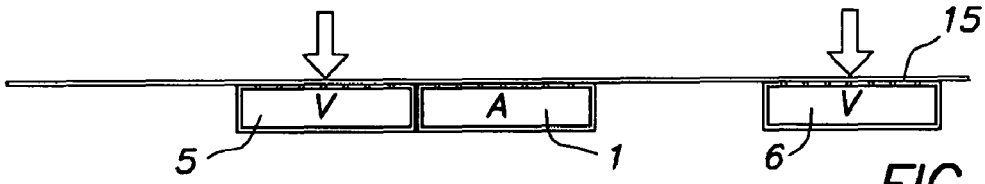
FIG. 3A to 3F gives the different positions of the tables and vacuum applied during different transport of the medium and the printing step.
Figure 3B:
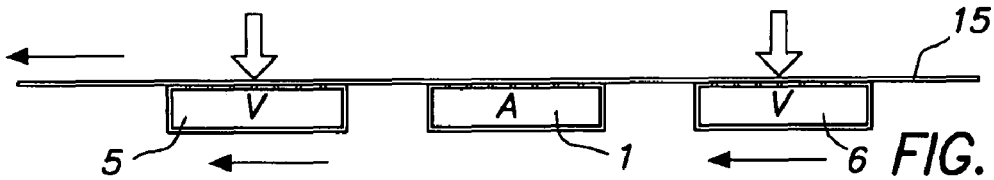
Figure 3C:
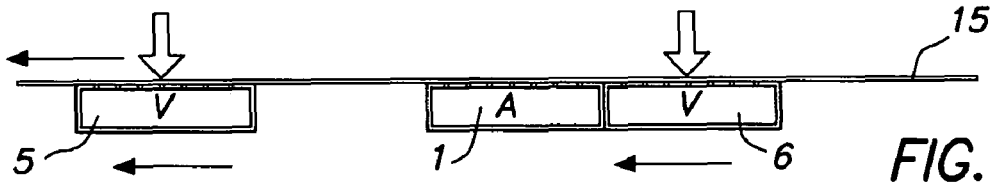
Figure 3D:
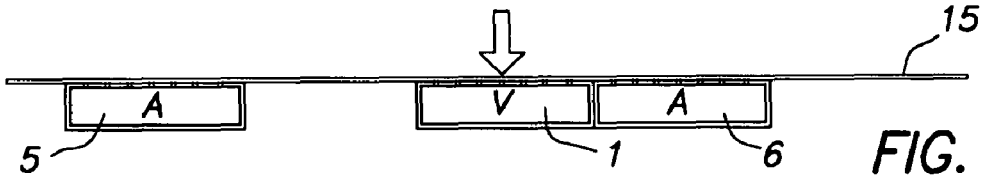

1. As the swath of the image is printed, the medium can be fe forward.
   - First, if not already done, the vacuum in the dynamic tables 5,6 is build-up by closing the blind valves 9 in the vacuum chambers 8 of the dynamic tables 5, 6. As the vacuum is generated the receiving medium 15 is drawn into contact by the force of the vacuum acting upon the receiving medium 15.
   - As the receiving medium 15 is fixed unto the dynamic tables 5,6 the blind valves 9 of the static vacuum table 1 are opened to release the grip of the static vacuum table on the receiving medium 15. As the vacuum is lost the receiving medium 15 is only attached to the dynamic vacuum tables 5,5. FIG. 3A
2. During the transport step FIG. 3B the dynamic tables 5,6 are set into movement by starting the step motors 13 to turn the spindles 12 driving the dynamic vacuum tables 5,6, located at both end of the dynamic vacuum tables 5,6. The speed of the two spindles 12 has to be kept the same to ensure parallel feeding of the receiving medium 15. This can be done by exact control of the two step motors 13 driving the spindles 12.
   - As both dynamic vacuum tables 5,6 are closely coupled by a rigid coupling or by the spindles 12 at both sides, they automatically have the same speed. In an alternative embodiment both vacuum tables 5,6 could have different driving mechanisms but this poses even more problems in speed control of the motors.
   - In an alternative embodiment the step motors 13 and spindles 12 for driving the dynamic vacuum tables 5,6 can be replaced by linear motors. Since the medium 15 transport is an incremental stepping transport with a short stroke travel distance, linear motors may be very well suited for this job.
   - During movement the dynamic vacuum table unit is moved in a downstream direction, i.e. dynamic table 6 is moved closer to or into contact with static vacuum table 1 while table 5 is pulled away from static vacuum table 1.
   - During movement the receiving medium 15 is translated together with the dynamic vacuum tables 5,6 unit to which it is adhered. The distance over which the step-wise translation is done can be controlled by the step motors 13 or by using a separate detection means such as an appropriate encoder.
   - It has been shown that an accuracy of 3 μm could be obtained using step motors, which is quite sufficient for inkjet recording systems.
3. After translation the dynamic vacuum table unit is in its downstream position (FIG. 3C) and the vacuum in the static vacuum table 1 is again established by closing the blind valves 9 and as the receiving medium 15 is adhered to the vacuum table 1 the next recording step can begin.
   - Vacuum of the dynamic vacuum tables 5,6 is removed by opening the blind valves 9 in the dynamic vacuum chambers 8 (FIG. 3D)

Figure 3E:
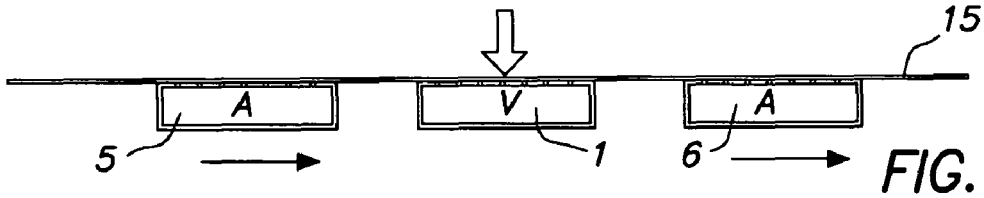

The transport module is put back into starting position (upstream position) by reverse rotation of the step motors 13. The dynamic vacuum table unit may be brought to the starting position (FIG. 3E) at a time outside the printing step as to avoid disturbing the printing. To speed up printing it is possible to perform the backwards step of the dynamic tables 5,6 during the printing by the shuttling printhead, but care has to be taken that the printing process is not disturbed by the mechanical movement of the dynamic tables 5,6.

Figure 3F:
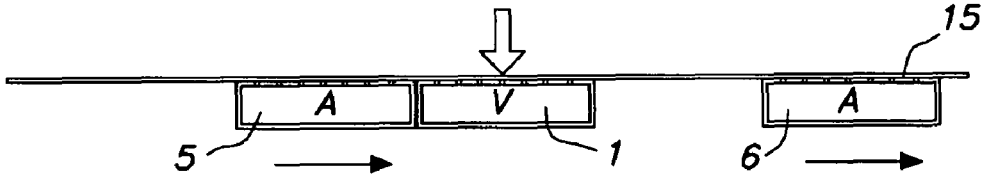

4. Before printing a swath of the image, the working area of the receiving media 15 is adhered to the static vacuum table 1. This is done by closing the blind valves 9 of the vacuum table 1, i.e. of the different vacuum chambers 8 that are covered by the receiving medium 15, so that vacuum can be build up inside these vacuum chambers 8.
   - As the vacuum builds up inside the vacuum chambers 8 the medium 15 is drawn into contact with the perforated base plate and is held in place by the force of the vacuum.
   - In FIG. 3F The dynamic vacuum table unit, comprising dynamic tables 5 and 6 at either side of the static table 1, is located in an upstream position relative to static table 1, i.e. dynamic table 6 is located more upstream (further away) from static table 1 than dynamic table 5 is located downstream from static table 1. Dynamic table 5 is located close to or in contact with the static table 1. The movement of tables 5 and 6 is stopped. Possibly the vacuum in the dynamic vacuum tables 5,6 is also activated to fix the receiving medium 15 even more rigidly. After the working area 4 of the receiving medium 15 is held on the base plate of the static table 1 it is possible to reliably print a swath of the image by shuttling the inkjet printhead 2. The distance between the printhead 2 and the receiving material 15 is at the desired value as the base plate of the static table 1 is present over the whole length and width of the working area 4.
   - The printhead 4 performs a fast scan over the receiving medium 15 along a guidance 3 and prints a swath of the image to be recorded. This can be done in a single pass over the working area 4 (unidirectional printing) or by a dual pass as the printhead 2 shuttles over the working area 4 and is returned to the start position and a partial image is printed each time (bidirectional printing).

Alternative Embodiments and Variations

Figure 4:
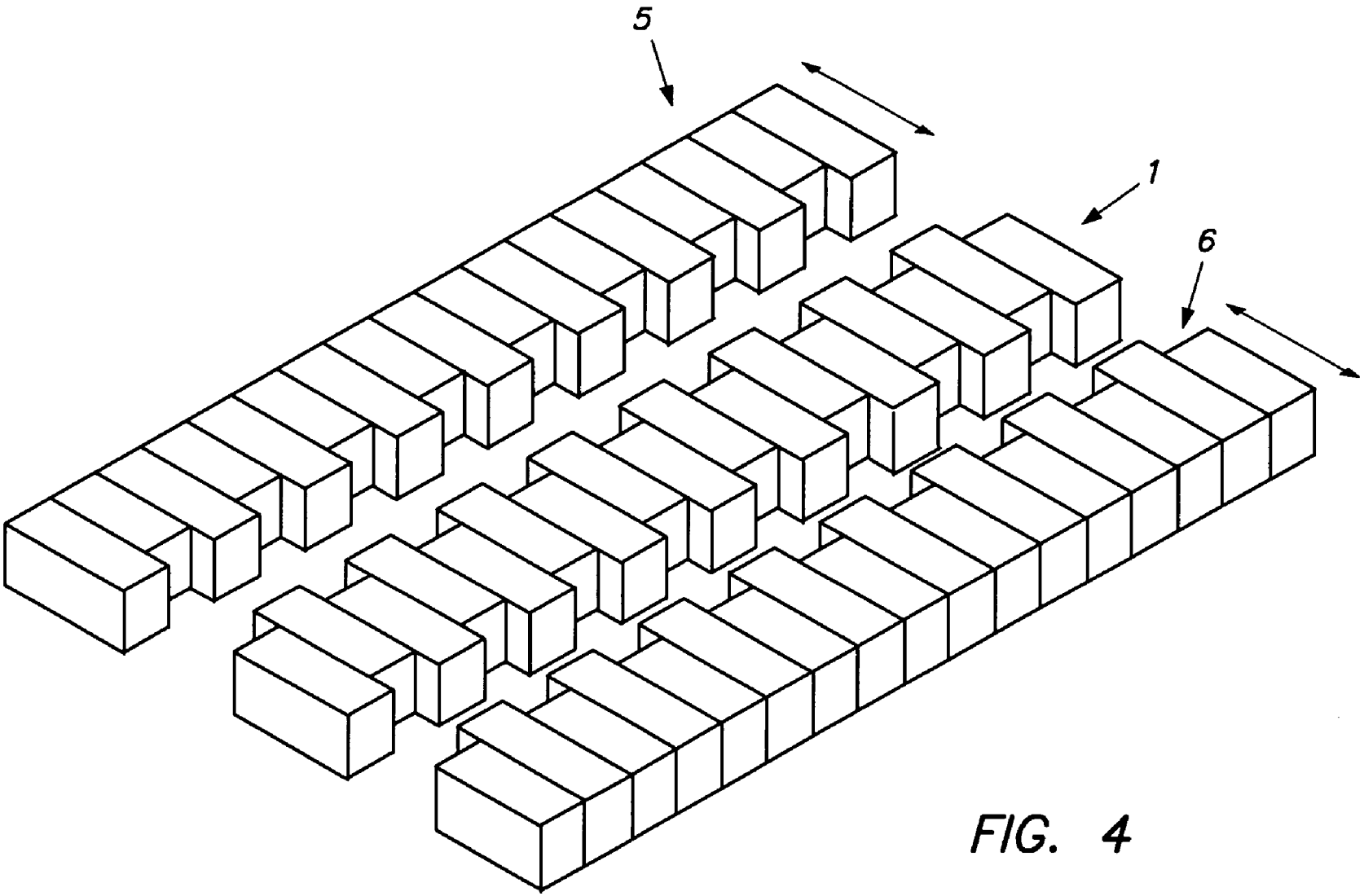
FIG. 4 gives an embodiment using toothed vacuum tables.

The interface between the static table 1 and the dynamic tables 5,6 can be a straight boundary, but in an alternative embodiment of the invention the tables 1,5,6 can fit to each other using a toothed pattern as shown in FIG. 4. However it is important that the whole working area 4 of the receiving medium 15 is substantially supported by the static vacuum table 1.

Figure 5:
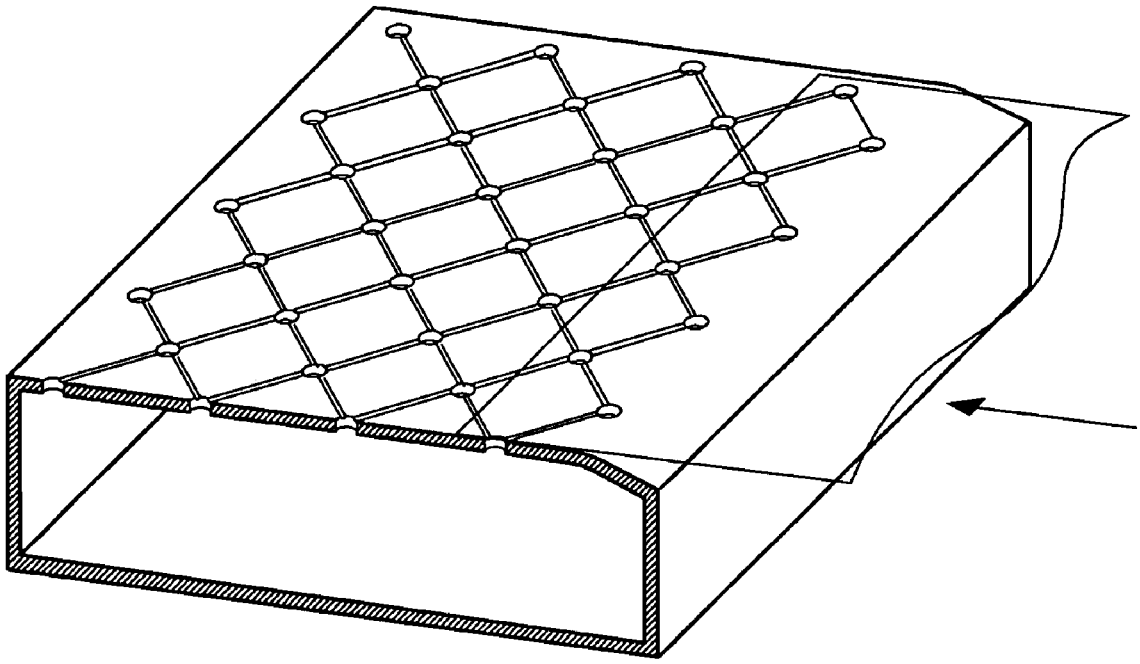
FIG. 5 shows a vacuum table having a bevelled edge to avoid paper block during sheet feeding.

The invention can be used for the step-wise transport of a web material to be printed on, but likewise is would be possible to transport sheet material using the system. An improvement shown in FIG. 5 that could be used in sheet feeding is that the upstream edges of one or more vacuum tables 1,5,6 is bevelled to avoid that the leading edge of a sheet hits the upstream edge of the table and a deviation would occur in feeding the sheet.

During printing of an image on the receiving medium each time a step having a certain step distance is made. However the step distance can be variable as this can be necessary in certain recording methods.

Media Holding Assistance

Figure 6:
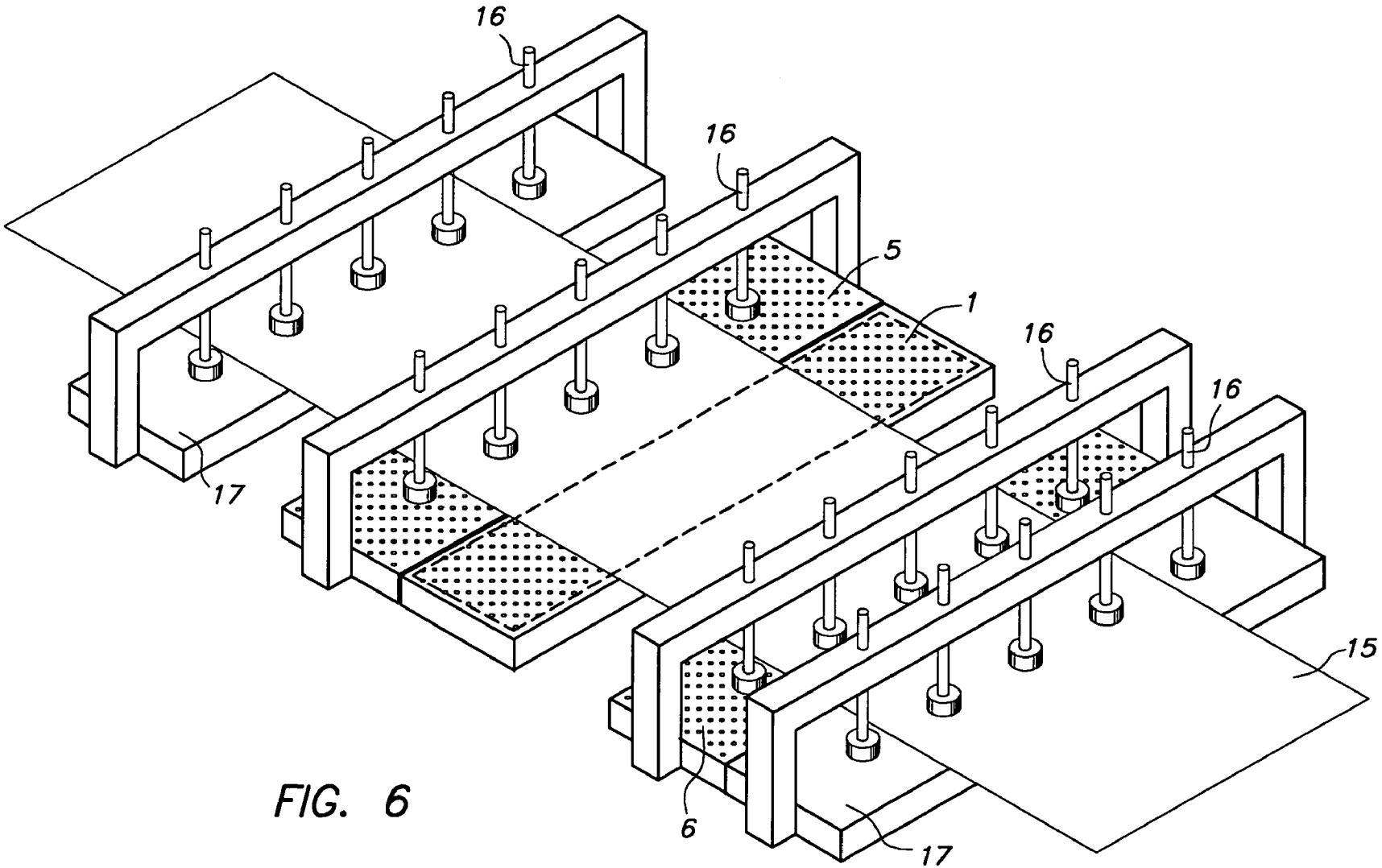
FIG. 6 Depicts a possible embodiment of a media holding assistance system.

When the printing medium 15 can not be adhered properly to the dynamic tables 5,6 by the vacuum, possibly due to porosity in the case of mesh-media, a combination of unevenness or rigidity in the case of rigid media, or any other reason, it is possible to provide the vacuum tables 5,6 with a additional clamps or force system to assist the holding of the media 15 during printing and transport. This media holding assistance system may contain rollers (either full width rollers extending across the full width of the media or a number of smaller rollers spread along the full width of the media), fingers or styli, clamps, suction cups, etc. The assistance system may be mounted upstream or downstream of the working area where the printing occurs, or at both sides of the working area. In a preferred embodiment, as shown in FIG. 6, the media holding assistance may have a set of styli 16 that can push the receiving medium 15 against the static 1 and/or dynamic table 5,6, to prevent receiving medium 15 from sliding away from these tables. More preferably the system may have two rows of styli 16, one row for pushing the receiving medium against the dynamic table 5,6 and the other row for pushing the receiving medium against the static table 1. Care must be taken that the styli 16 located above the static table 1 do not interfere with the working area 4 of the medium 15 where the printhead 2 is moved back and forth across the medium in the a fast scan direction for printing a swath of the image. If the table 1 is wide enough in the direction of receiving medium transport, the styli 16 can be placed just before and/or after the working area 4. If the static table 1 is to narrow, the styli 16 for assisting the vacuum table 1 in holding the receiving medium 15 during printing may be placed outside, i.e. upstream or downstream the static/dynamic table assembly, i.e. on a frame part 17 of the printing apparatus where the receiving medium 15 slides over. This configuration is illustrated in FIG. 6. As discussed above, the static 1 and dynamic 5,6 tables work in harmony with each other in a repetitive cycle of holding the receiving medium 15, e.g. the dynamic table 5,6 holding the medium 15 while moving the dynamic table 5,6 downstream, and releasing the receiving medium 15, e.g. the dynamic table 5,6 releasing the medium 15 while moving the dynamic table 5,6 upstream again. The styli 16 from the media holding assistance system may be activated simultaneously with the activation of the vacuum on the dynamic or static vacuum table, in which case the assisting styli 16 operate in the same repetitive cycle as the vacuum of the tables 1,5,6, but other activation schemes are perfectly possible. The styli 16 may be activated by pressed air and approach the receiving medium 15 from above pushing it against the supporting table 1,5,6 or frame part 17 underneath the styli 16. In a preferred embodiment, the amount and location of the styli 16 is chosen so as to have an equal assistance of the receiving medium 15 transport over the full width of dynamic/static table or frame part in a direction perpendicular to the medium transport direction. Alternative embodiments for the styli 16 may be roller (operation from above the receiving medium 15), suction cups (operating from underneath the receiving medium 15 and assisting to the small vacuum holes in the tables) or any other suitable means. The styli, rollers, suction cups, etc. may be resiliently mounted so as to not damage the receiving medium 15 on impact.

When a media holding assistance system is provided at the downstream side of the working area of printing, care must be taken the assistance means do not damage the image that was just previously printed. This may be the case in printing systems using inks that take time to dry. Sometimes it may be sufficient to have active drying means in or near the working area 4, e.g. on the shuttle together with the printhead 2, so that the printed pixels or swaths are at least "touch dry" when leaving the working area 4 and entering the area of the downstream dynamic table and/or media holding assistance system.

The static/dynamic table assembly and vacuum support may also be assisted by roller pairs known from web transport and web tensioning systems. The roller pairs can hold the receiving medium in a fixed and tensioned state during printing wherein the vacuum of the static/dynamic table assembly is for holding the receiving medium flat, and forward the receiving medium in the transport direction in between the fast scans for printing a swath of the image. The roller pairs are preferably tension controlled and limited with a maximum torque to avoid slip of the receiving medium over the vacuum tables, i.e. to avoid that the tension of the roller pairs onto the receiving medium exceeds the holding force of the vacuum tables. Roller pair embodiments may include two independent rollers, one upstream and another downstream the working area of the receiving medium, operation against a sliding or rolling contact area on the printer frame or dynamic tables. The receiving medium moves between a roller and a part of the printer frame or dynamic table.

Alternatively the embodiment may include two roller pairs, one upstream and another downstream the working area of the receiving medium. The receiving medium then passes in the nip of the rollers of each of the roller pairs.

When mesh-media or rigid media are used, onto which the holding force of the vacuum tables is low, the roller pairs may be the major means for forwarding and tensioning (if applicable) the receiving medium. In other words, the static/dynamic vacuum tables functionality in the media transport is mainly to support the mesh and rigid media during transport.

It has to be noted that it is not necessary that the dynamic vacuum tables need to be lowered when moving upstream underneath the web.

The stepping motors 13 can be directly coupled to the spindle drives 12 or they can be coupled using a gearing system. All depends upon the type of step-motor 13, spindle 12 and desired accuracy and speed of the movement. The two spindles need to operate exactly at the same speed, so preferably high quality motors are used which are coupled to each other by electronic gearing.

Another important aspect is that the inkjet printhead needs to be at a constant distance from the receiving medium. As the printhead shuttles, it can be understood that an ink drop also follows a sloped path in its way to the receiving layer. Any distance variation will therefor result in a dislocation of the ink dot in the fast-scan direction. Distance variation can be caused by a variation in height of the printhead.

The present transport system is capable to transport a web as shown directly from the feeding roll, although, dependent upon the type of medium to be fed, it may be advantageous to avoid tension on the receiving medium at the print location by providing a separate web feed module unrolling the feeding roll and buffering a lot of the feeding roll tension. This can provide even more accurate feeding. It has been found a significant advantage that the operation of the static/dynamic table media transport generates no shear forces in the receiving medium and that the receiving medium is in a "tensionless state" during printing.

Printing on Mesh-Media/Border-Less Printing

When printing onto mesh-media 18 that is not supported on a liner material, it is inevitable that printing ink or other marking material that is used for printing, is deposited through the mesh of the media, straight onto the static table 1. During the subsequent sliding transport of the media over the static table, the ink or marking material deposited on the static table is smudged on the back the mesh-media. A similar problem occurs when border-less printing onto receiving media 15 is targeted, e.g. poster or photo printing. Printing up to the border without going over the border is a feature of a printing apparatus that is very hard to realise.

Figure 7:
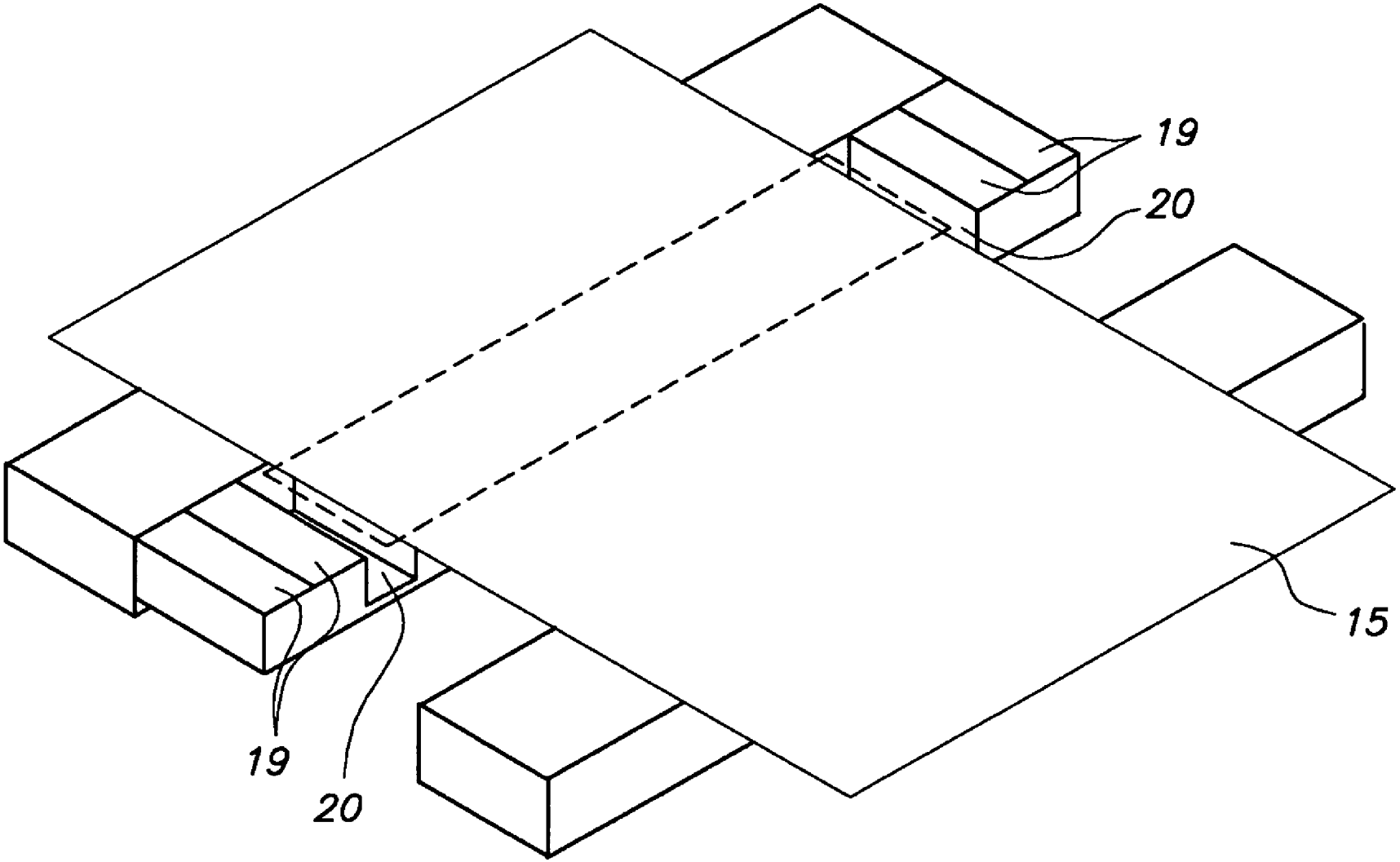
FIG. 7 Shows the replacement of some removable static table sections for border-less printing.
Figure 8:
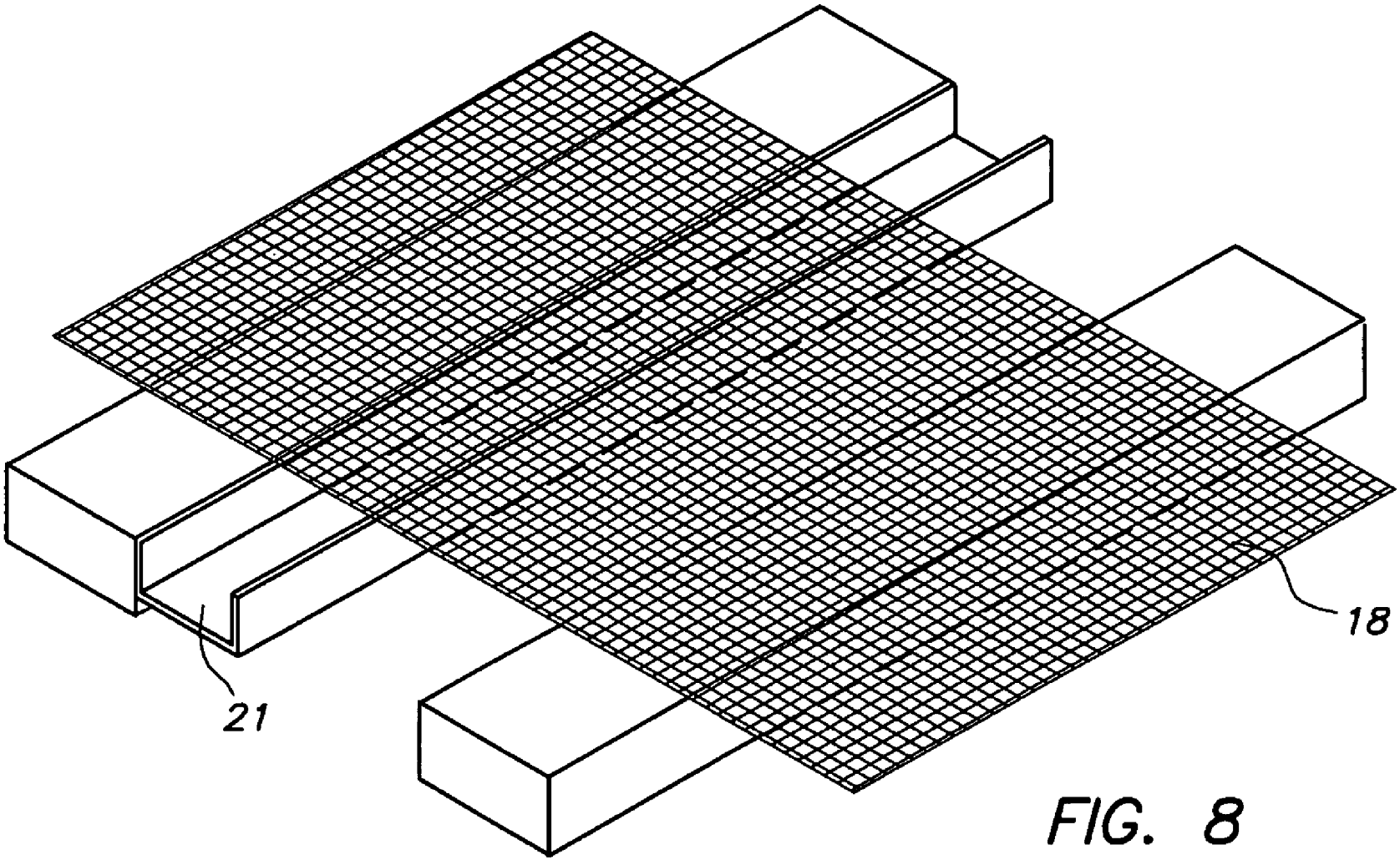
FIG. 8 shows the replacement of removable static table sections by a gutter for mesh printing.

A solution to the problems of smudging ink or marking material on the static table 1 is provided by a static table 1 that is segmented along the length of the table, i.e. the dimension along the fast scan direction, in a number of removable sections 19. As illustrated in FIGS. 7 and 8, the removable sections may be replaced by bucket sections 20 or a single full-length bucket 21 may be provided standard underneath the full-length of the static table. These removable sections may be used in two different configurations:

Before border-less printing on an ink or marking material impermeable receiving medium 15, the table sections 19 that are not fully supporting the receiving medium are removed and depending on the embodiment replaced with bucket sections 20. This results in a static table 1 that is, in operation, fully covered by the receiving media 15. The ink or marking material that is possibly printed outside of the receiving medium 15 area is collected in the inserted bucket sections 20 or the standard full-width bucket 21.

When mesh-media 18 is used, all sections 19 of the static table 1 are removed and replaced by bucket sections 20 if applicable. During printing the mesh-media 19 will be still supported and maintained in a fixed position by the application of the vacuum of the dynamic tables 5,6 possibly assisted by the media holding assistance means described above.

An even more preferred embodiment of the removable static table sections 19 allows maximum support of the receiving medium 15 by not removing the whole of the static vacuum table section 19 but limiting the area that is removable from the static vacuum table section to the working area 4 of the printhead 2 or the shuttle, i.e. the area where ink or other marking material may be deposited. If the static table 1 is wider, along the direction perpendicular to the fast scan direction, than the width of a print swath, then only the area of the static table sections 19 corresponding with the area 4 of a print swath are removed or replaced with buckets 20. The remaining part of the static table sections 19 that are not corresponding with a print swath remain in place and may keep on supporting the receiving media 15 during printing of a print swath.

In this preferred embodiment the static vacuum table 1 is divided into sections along the length of the table and each section is again divided into the width direction into a working area part and a support part.

It may be advantageous if the vacuum table sections 19, working area parts and bucket sections 20 are individually mountable as inserts onto the vacuum chambers 8 underneath the static vacuum table 1. In this case, replacing table sections etc. does not involve changing the vacuum chamber configuration underneath the table.

Vertically Adjustable Static Table

It has been said before that the distance between the marking tool, e.g. the ink jet printhead 2, and the receiving medium 15 must be very well controlled to have an optimal functioning digital printing process. When rigid media 15 are used, the flatness of the media 15 itself will be of major importance. When flexible media 15 are used, the flatness of the static table 1 on which the flexible media is pulled via the vacuum will be of major importance. The static vacuum table 1 is therefore adjustable in height at multiple locations so that it can conform to the height profile of the shuttle or printhead along the fast scan direction. In a preferred embodiment, the static table 1 may be divided into multiple sections 19 along the fast scan direction. These sections may individually be controlled at different heights. This provided optimum calibration of the distance between the marking tool 2 and the receiving medium 15, along successive sections of the fast scan movement. Height adjustment of the static table sections 19 may be realised by one or more height adjustment screws per section, or any other means known in the art for adjusting the height of the table sections 19. If multiple adjustment screws per table section 19 are used, not only the average height of the table section 19 but also the inclination of that table section 19 may be adjusted. In a preferred embodiment the static table sections 19 may have a dimension, along the fast scan direction, in a range of a couple of cm up to tens of cm, depending on the targeted or required accuracy of the distance marking tool 2 to receiving medium 15.

Having described in detail preferred embodiments of the current invention, it will now be apparent to those skilled in the art that numerous modifications can be made therein without departing from the scope of the invention as defined in the appending claims.

The invention claimed is:

1. A receiving medium transport system arranged to transport a receiving medium in a printing system, the receiving medium including a working area on which a swath of an image is printed during a movement of at least one printhead across a widthwise direction of the receiving medium, the receiving medium transport system comprising:

a static table arranged to support the receiving medium and to apply a first holding force on the receiving medium to temporarily hold the receiving medium on the static table as the at least one printhead moves across the working area of the receiving medium; and at least a first dynamic table arranged to apply a second holding force on the receiving medium to temporarily hold and to transport the receiving medium in a lengthwise direction of the receiving medium in the printing system; wherein each of the static table and the first dynamic table are arranged to extend entirely across a widthwise direction of the receiving medium.

2. The receiving medium transport system according to claim 1, wherein the static table includes a vacuum chamber arranged to hold the working area of the receiving medium stationary when the swath of the image is printed; and the first dynamic table includes a vacuum chamber arranged to hold and transport the receiving medium when the receiving medium is transported.

3. The receiving medium transport system of claim 1, further comprising a second dynamic table, wherein the static table is located in between the first dynamic table and the second dynamic table.

4. The receiving medium transport system according to claim 1, wherein the first dynamic table and the static table include toothed shaped edges arranged such that the tooth shaped edges of the first dynamic table fit into the tooth shaped edges of the static table.

5. The receiving medium transport system according to claim 1, wherein at least one of the first dynamic table and the static table includes a bevelled upstream edge.

6. The receiving medium transport system according to claim 1, wherein at least one of the first dynamic table and the static table includes a plurality of separate vacuum chambers.

7. The receiving medium transport system according to claim 6, wherein each of the plurality of separate vacuum chambers includes at least one blind valve arranged to switch on and off a vacuum therein by opening and closing the at least one blind valve.

8. The receiving medium transport system according to claim 1, further comprising a second dynamic table and first and second guide rails including at least one spindle drive mechanism, the first and second guide rails arranged to support and guide the first and second dynamic tables as the first and second dynamic tables are moved simultaneously along the first and second guide rails by the at least one spindle drive mechanism.

9. The receiving medium transport system according to claim 8, wherein the first guide rail is rigidly mounted to the receiving medium transport system and the second guide rail is suspended from the receiving medium transport system so as to enable expansion of the first and second dynamic tables.

10. The receiving medium transport system according to claim 8, wherein the first and second guide rails are common to the first and second dynamic tables.

11. An ink jet printing system comprising:

the receiving medium transport system according to claim 1; wherein the at least one printhead is an ink jet printhead.

12. A receiving medium transport system arranged to transport a receiving medium in a printing system, the receiving medium including a working area on which a swath of an image is printed during a movement of at least one printhead across the receiving medium, the receiving medium transport system comprising:

a static table arranged to support the receiving medium and to apply a first holding force on the receiving medium to temporarily hold the receiving medium on the static table as the at least one printhead moves across the working area of the receiving medium; and at least one dynamic table arranged to apply a second holding force on the receiving medium to temporarily hold and to transport the receiving medium in the printing system; wherein the static table is arranged to support the entire working area of the receiving medium as the at least one printhead moves across the working area of the receiving medium, and the at least one dynamic table is arranged to not support any portion of the working area of the receiving medium as the at least one printhead moves across the working area of the receiving medium.

* * * * *